US005561346A

United States Patent [19]

Byrne

[11] Patent Number: 5,561,346

[45] Date of Patent: Oct. 1, 1996

[54] LED LAMP CONSTRUCTION

[76] Inventor: David J. Byrne, 1649 Daws Rd., Blue Bell, Pa. 19422

[21] Appl. No.: 288,084

[22] Filed: Aug. 10, 1994

[51] Int. Cl.[6] ..... H01J 5/16; F21D 1/00; F21S 1/10

[52] U.S. Cl. ..... 313/512; 313/113; 315/185 R; 315/189; 315/250; 315/324; 362/240; 362/252; 362/800

[58] Field of Search ..... 313/512, 498, 313/113, 315, 316; 315/71, 52, 185 R, 189, 312, 250, 200 R, 324; 362/800, 240, 252

[56] References Cited

U.S. PATENT DOCUMENTS

| | | | |
|---|---|---|---|
| 4,211,955 | 7/1980 | Ray . | |
| 4,727,289 | 2/1988 | Uchida . | |
| 4,783,726 | 11/1988 | Wang | 362/252 |
| 4,939,426 | 7/1990 | Menard et al. . | |
| 5,160,200 | 11/1992 | Cheselske . | |

*Primary Examiner*—Sandra L. O'Shea
*Assistant Examiner*—Matthew J. Esserman
*Attorney, Agent, or Firm*—Armand M. Vozzo, Jr.

[57] ABSTRACT

An improved LED lamp construction is disclosed having a plurality of LEDs electrically interconnected and mounted upon opposed rounded surfaces formed at one end of the lamp body. The opposed rounded surfaces comprise a substantially semi-spherical lamp head concavely open at the upper end of the lamp and a cover similar in curvature to the head and fixed across the open end thereof in a convex position relative thereto. The LEDs are arranged in multiple series groups connected in parallel and disposed circumferentially along the rounded surfaces so as to project radially therefrom in substantially all directions. The LEDs are electrically and mechanically connected to a conventional screw-type base at the opposite end of the lamp body through an intermediate stem. Depending upon the nature and level of the power source being provided to the screw-type base, the stem may-house a conventional regulator circuit intended to convert an applied level of A.C. voltage to a relatively low D.C. voltage designed to operate the LEDs. The present LED lamp is particularly suited for engagement and use within conventional traffic signal encasements of the type having a paraboloid mirror and light-diffusing lens cover wherein the LED emissions from the lamp optically combine to produce a uniform light beam.

14 Claims, 3 Drawing Sheets

LED LAMP CONSTRUCTION

BACKGROUND OF THE INVENTION

The present invention relates to lamp construction and more particularly to an improved lamp construction having a plurality of light-emitting diodes (LEDs) mounted circumferentially about opposed rounded surfaces at the head of the lamp so that light from the LEDs may be projected radially therefrom in substantially all directions.

As illumination sources, LED lamps have long been proposed as an improved substitute for small-sized incandescent lamps because of the LED's superior reliability, rated life and lower power consumption. Various LED lamps have therefore been designed and have effectively replaced small incandescent pilot lamps used as indicator lights on display panels and in various electronic equipment. Examples of such LED lamps are described in U.S. Pat. Nos. 4,211,955, 4,727,289 and 5,160,200.

Existing LED lamp designs have not, however, been as effective in generating brighter amounts of illumination for longer-range signaling purposes, such as those lights used in highway traffic signals and at railroad crossings. Since such signaling lights are required to be readily visible to observers throughout a wide range of viewing angles, they must generate not only a strong beam but one that is substantially uniform over a wide pattern of illumination. Producing a sufficiently bright and uniform beam of illumination has been difficult to achieve using LEDs because of the unidirectional feature of their light emissions that is further characterized by a significant reduction in luminous intensity when observed at angles displaced slightly from the optical-centerline of the LED. While various designs have been developed for grouping LEDs to increase the strength of their illumination, such designs have not addressed the characteristic limited range of luminous intensity exhibited by the LEDs in such a manner that allows LEDs to be used in wide ranging signal light applications.

SUMMARY OF THE INVENTION

Accordingly, it is a general purpose and object of the present invention to provide an improved LED lamp construction that effectively produces sufficient illumination for signal light applications.

Another object of the present invention is to provide an LED lamp that generates light in a bright and substantially uniform pattern so that the light therefrom may be observed from a distance over a wide range of viewing angles.

Still another object of the present invention is to provide an improved LED lamp construction that readily and more efficiently replaces existing incandescent bulbs heretofore used in commercial signaling devices such as those employed in highway traffic signaling standards.

A still further object of the present invention is to provide an improved LED lamp construction that can be economically manufactured and made adaptable for use in a wide variety of household, commercial and industrial lighting applications.

Briefly, these and other objects of the present invention are accomplished by an improved LED lamp construction having a plurality of LEDs electrically interconnected and mounted upon opposed rounded surfaces at one end of the lamp body. The opposed rounded surfaces comprise a substantially semi-spherical lamp head concavely open at the upper end of the lamp and a cover similar in curvature to the head and fixed across the open end thereof in a convex position relative thereto. The LEDs are arranged in multiple series groups connected in parallel and disposed circumferentially along the rounded surfaces so as to project radially therefrom in substantially all directions. The LEDs are electrically and mechanically connected to a conventional screw-type base at the opposite end of the lamp body through an intermediate stem. Depending upon the nature and level of the power source being provided to the screw-type base, the stem may house a conventional regulator circuit intended to convert an applied level of A.C. voltage to a lower D.C. voltage designed to operate the LEDs. The present LED lamp is particularly suited for engagement and use within conventional traffic signal encasements of the type having a paraboloid mirror and light-diffusing lens cover wherein the LED emissions from the lamp optically combine to produce a uniform light beam.

For a better understanding of these and other aspects of the present invention, reference may be made to the following detailed description taken in conjunction with the accompanying drawing in which like reference numerals designate like parts throughout the figures thereof.

DESCRIPTION OF THE PREFERRED EMBODIMENT

Figure 1:
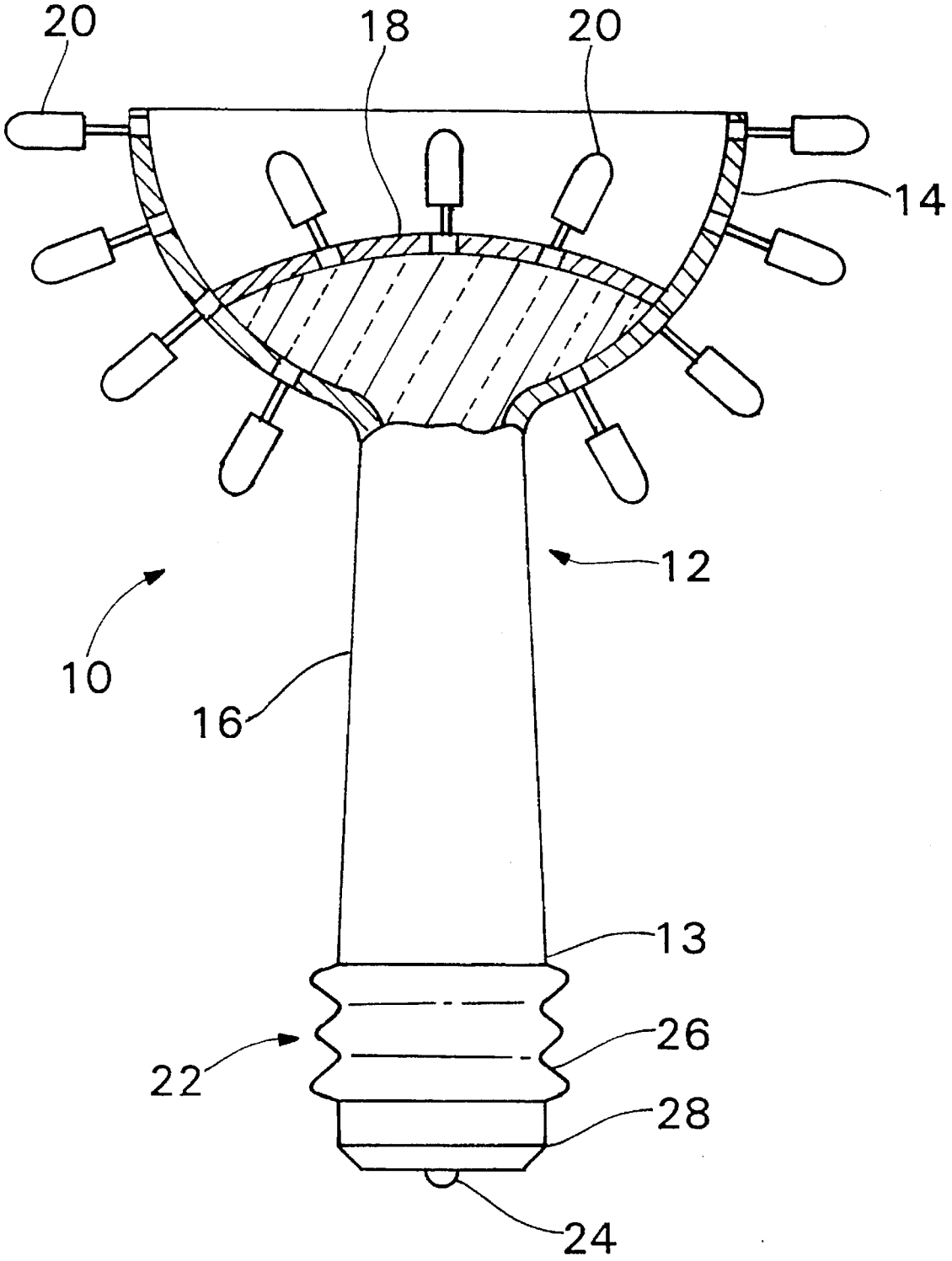
FIG. 1 is a side elevation view, partially sectioned, of an LED lamp constructed in accordance with the presented invention.

Referring now to the drawings and at first to FIG. 1, a preferred embodiment of an LED lamp, generally designated 10, is shown constructed in accordance with the present invention. The LED lamp 10 comprises a main body 12 extending lengthwise along a central axis between a circular base end 13 and rounded head 14. The lamp body 12 is preferably hollowed and cylindrical in its form, having a substantially uniform outer diameter along an intermediate stem 16 formed between the base end 13 and the bottom of the lamp head 14. The outer diameter of the lamp head 14 gradually widens from the bottom to the upper end thereof thereby providing the head with its rounded configuration. The lamp body 12, particularly including the stem 16 and head 14, is preferably constructed as an integral member and molded from a strong but lightweight insulating material, such as fiberglass or plastic.

Lamp head 14, as shown in FIG. 1, is substantially semi-spherical and concavely open at its upper end, but may alternatively be paraboloidal within the teachings of the present invention. Inside the open end of the lamp head 14, a rounded cover 18 similar in radius of curvature to the head is oppositely disposed and fixed across the concave interior of lamp head so as to be convex relative thereto. Made of the same insulating material as the lamp body 12, the cover 18 is typically recessed in its position within lamp head 14 and is preferably sealed thereto upon assembly of the lamp 10 and its electrical components as described in greater detail hereinbelow. Sealing of the cover 18 to the interior of lamp head 14 may be effected by conventional means using an epoxy resin of silicone or the like having substantially high insulating quality, which epoxy resin may be further used to fill the hollowed interior of the lamp body 12 and hold in place its contained components.

Figure 2:
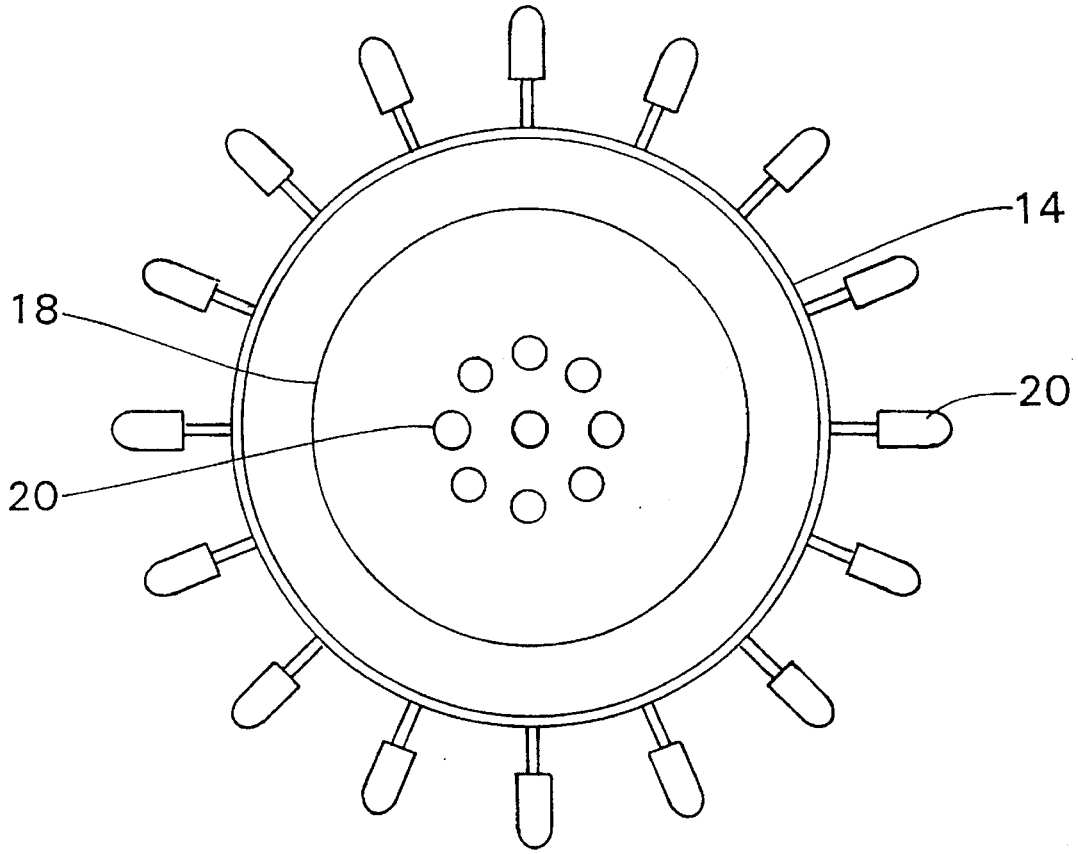
FIG. 2 is a top view of the LED lamp of FIG. 1.

Referring now to FIG. 2 in conjunction with FIG. 1, a plurality of LEDs 20 are secured to and mounted upon the opposed rounded surfaces of the exterior of the lamp head 14 and the inner cover 18. The LEDS 20 are spaced apart and arranged in a relatively symmetrical pattern about the rounded mounting surfaces of the head 14 and cover 18, and are disposed therealong and relative thereto so as to project in substantially radial directions. As best viewed in FIG. 2, the LEDs 20 mounted upon the lamp head 14 are radially disposed 360° around the perimeter at the upper end of the lamp head and are uniformly spaced apart from each other. The radial spacing between the LEDs 20 may vary based upon the amount of light output intended from the lamp 10 and the number of LEDs determined as necessary therefor. As better evident in FIG. 1, the LEDs 20 on the lamp head 14 are further disposed and spaced apart radially between the upper end and the bottom of the lamp head so that the LEDs project uniformly around the entire outer surface of the lamp head. The LEDs 20 mounted upon the inner cover 18 are also disposed radially relative thereto and are typically grouped at the top of the cover to project forward therefrom in a more limited angular pattern. In mounting the LEDs 20, the solid-state body of each LED unit should be firmly positioned near to or upon the respective rounded surfaces of the head 14 and cover 18 with the electrical leads of each LED being inserted through small openings in the respective surfaces for mechanical and electrical connections. Use of conventional miniature connector clips (not shown) fitted into each respective opening in the rounded mounting surfaces of the head 14 and cover 18 provide an alternative means for securing the LEDs 20 in proper position and further facilitating LED replacement if necessary.

The LEDs 20 employed in the present invention are conventional units preferably of a high intensity, ultra-bright emission quality commercially available in a variety of colors such as red, green or amber. Other colors, including white, would be suitable for the LEDs 20 used in accordance with the present invention. One example of a suitable series of LEDs 20 are those currently manufactured by Hewlett Packard under Part Nos. HLMP-810X and HCMP-C100/C110.

The LEDs 20 are electrically interconnected to selected other LEDs in series arrays, as shown and described in greater detail below in reference to FIG. 3. Conventional means such as soldering, applied to the leads of each LED 20 may be used for making the proper electrical interconnections as well as for providing a mechanical joint between the LEDs and their respective mounting surfaces. However, other means for electrically interconnecting the LEDs 20, such as electrical wires, may also be used.

Figure 3:
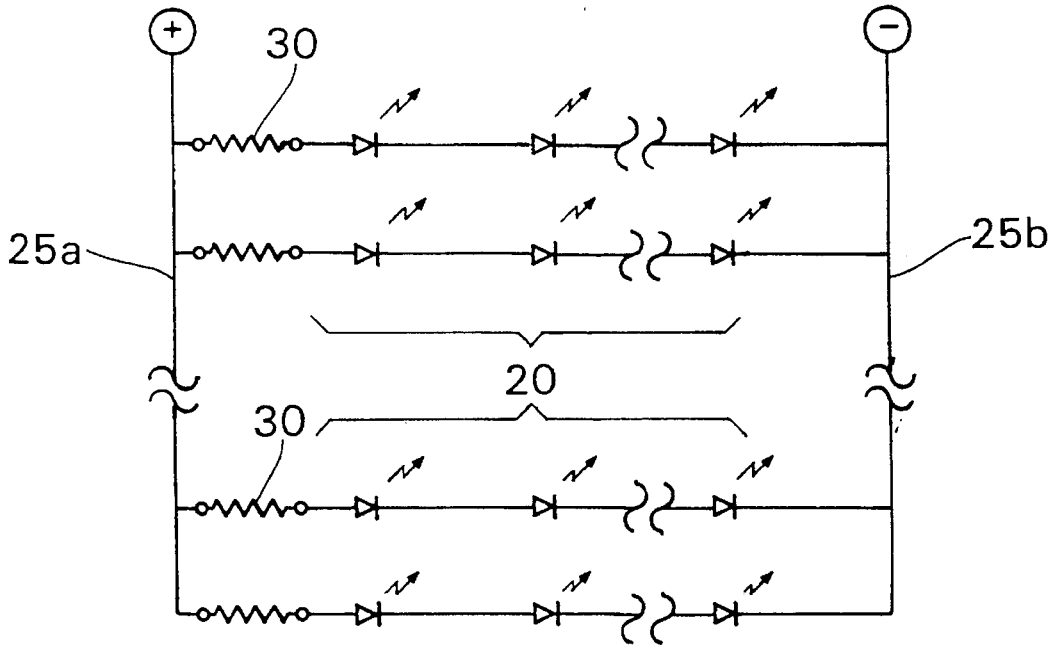
FIG. 3 is a schematic circuit diagram showing the electrical wiring of the LED lamp of the present invention.

Referring now to FIG. 3 in conjunction with FIGS. 1 and 2, the electrical circuitry for the present invention is shown in diagrammatic form. Powered by a low voltage D.C. source, typically about 12 volts, the LEDs 20 are connected together in parallel branches of series groups of four or more LED units with a low power series resistor 30 further housed in stem 16 connected to the LEDs in each branch for controlling the operating current therethrough to design levels. Typical range of resistance values for the series resistor 30 is between 40–150 ohms. The appropriate operating D.C. voltage may be directly supplied to the lamp 10 and in such case, is applied thereto via a conventional incandescent lamp screw-type base 22 affixed and sealed to the base end 13 of the lamp body 12. The screw-type base 22 of this type has an inner electrical terminal 24 separated from an outer electrical terminal 26 by a circular insulating member 28 and thus receives the operating voltage upon engagement with a mating socket member, such as theft shown in FIG. 4, to which the voltage has been applied. This D.C. voltage is then fed to respective ends of each parallel branch circuit via common electrical lines **25*a* and 25*b* extending internally through the stem 16 from the inner and outer terminals 24 and 26 of the screw-type base 22 to the respective LED branch circuits. In the event that an A.C. voltage is provided as a power source rather than the described operating D.C. voltage, a conventional voltage regulator circuit capable of converting the A.C. to D.C. voltage and of further maintaining the output voltage level would be required for proper lamp operation. Such an additional regulator circuit may be incorporated into the circuitry of the present lamp 10 and housed, if necessary, in the stem 16 of the lamp body 12**.

Figure 4:
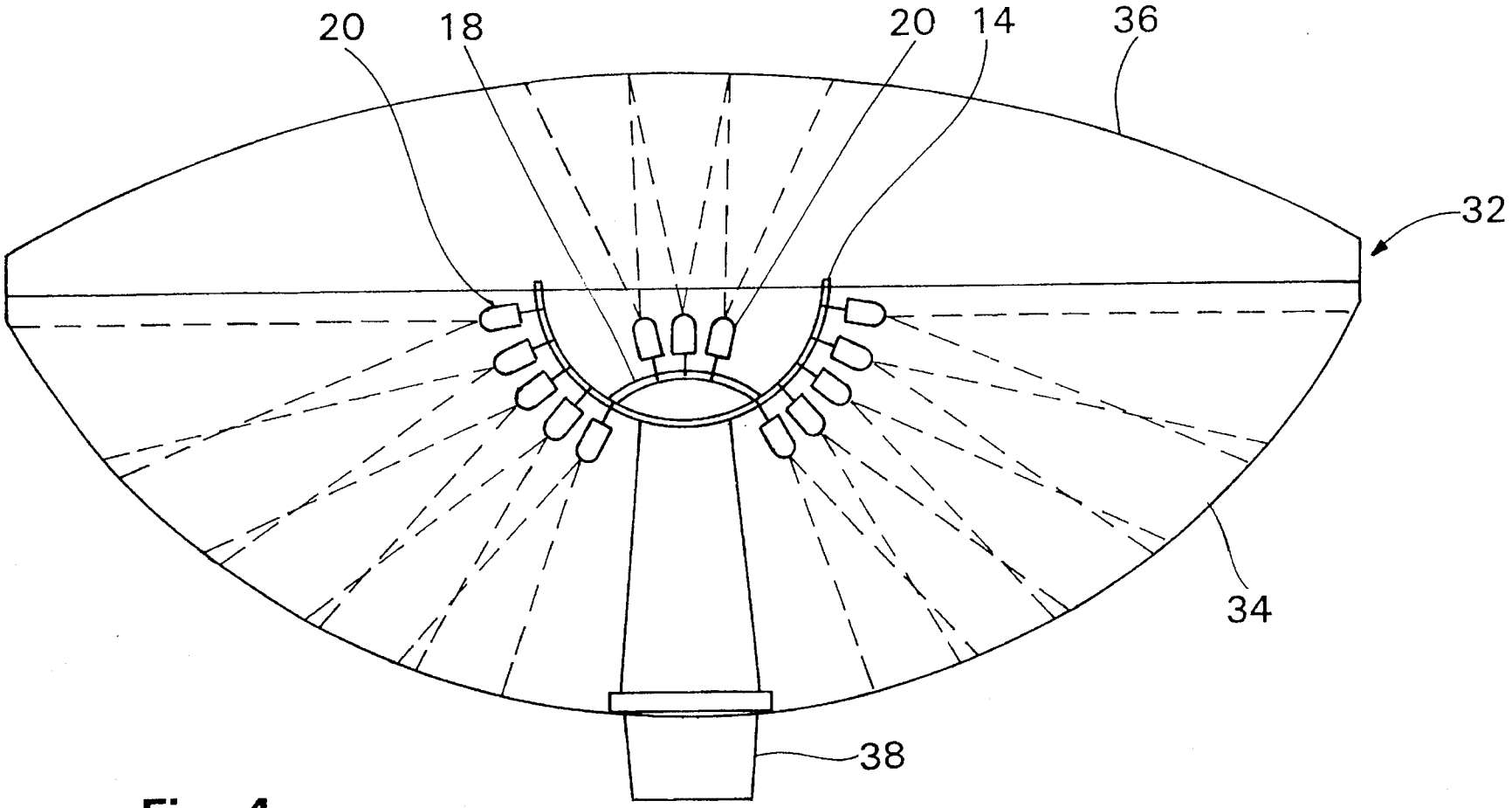
FIG. 4 is a schematic side view of the LED lamp engaged in position within a conventional traffic signal encasement.

Referring now to FIG. 4 in conjunction with FIGS. 1–3, the LED lamp 10 of the present invention is shown in operative engagement within a basic assembly of a conventional traffic signal light encasement 32. The basic traffic signal light encasement 32 includes a paraboloid mirror 34 for reflecting light generated in the encasement, a lens cover 36 for diffusing the reflected light, and a socket connector 38 secured centrally to the bottom of the mirror and adapted to engage a standard lamp base for voltage transfer. With the appropriate operating voltage applied to the socket connector 38 and the lamp base 22 intimately engaged therewith, operating current is delivered to all of the LED branch circuits and light emissions are generated from all of the LEDs 20 mounted along the opposed rounded surfaces of the lamp head 14 and inner cover 18. Emissions from the LEDs 20 mounted upon the inner cover 18 project substantially forward with some limited angular displacement to strike the lens cover 36 for diffusion through the central section thereof. Emissions from the LEDs 20 surrounding the outer surface of lamp head 14 project 360° around the lamp 10 and onto substantially the entire reflective surface of mirror 34. All of these LED emissions so projected onto the mirror 34 are reflected upon the surrounding lens cover 36 for diffusion therethrough and in combination with the light diffused through the central portion of the cover, produce a bright and uniform beam of light generally observable by a viewer.

Therefore, it is apparent that the disclosed invention provides an improved LED lamp construction that can effectively produce a sufficient beam of illumination for signal light applications. The present LED lamp is constructed so that the light emissions from the respective LED elements may be reflectively combined to generate a bright and substantially uniform beam observable from a far distance and over a wide range of viewing angles. Furthermore, the disclosed LED lamp provides a ready and more efficient replacement to existing incandescent lamps generally heretofore employed in highway traffic signal systems. The present LED lamp provides greater reliability over a longer life and uses far less energy than the present incandescent lamps used in such traffic signal systems. In addition, the present LED lamp construction can be economically manufactured and made readily adaptable to a wide variety of household, commercial and industrial lighting applications.

Obviously, oilier embodiments and modifications of the present invention will readily come to those of ordinary skill in the art having the benefit of the teachings presented in the foregoing description and drawings. For example, the semi-spherically shaped mounting surface of the lamp head 14, described above in reference to FIGS. 1 and 2, may be made substantially spherical with LEDs 20 fully encircling the lamp head by raising the position of the inner cover 18 within the concave interior to a position atop the head and expanding the cover dimension to maintain the enclosure. It is therefore to be understood that various changes in the details, materials, steps and arrangement of parts, which have been described and illustrated to explain the nature of the present invention, may be made by those skilled in the art within the principles and scope of the invention as are expressed in the appended claims.

What is claimed is:

1. A light-emitting diode lamp comprising:

a lamp body extending along a central axis and constructed having opposed rounded surfaces sealed together at one end thereof;

a plurality of light-emitting diodes electrically interconnected and mounted upon the opposed rounded surfaces of said lamp body to project light emissions in respective radial directions relative to the rounded surfaces; and electrical means connected to said lamp body at the other end thereof and coupled to said light-emitting diodes for conducting electrical power thereto.

2. A light-emitting diode lamp according to claim 1, wherein the opposed rounded surfaces comprise:

a concave head formed symmetrically about the central axis of said lamp body open at the upper end thereof; and a convex cover adapted to engage the open end of said concave head symmetrically across the interior thereof.

3. A light-emitting diode lamp according to claim 2, wherein said concave head is semi-spherical in configuration.

4. A light-emitting diode lamp according to claim 2, wherein said concave head is paraboloidal in configuration.

5. A light-emitting diode lamp according to claim 2, wherein:

said plurality of light-emitting diodes are disposed circumferentially along the respective rounded surfaces of said concave head and said convex cover, and electrically arranged in multiple series groups interconnected in parallel.

6. A light-emitting diode lamp according to claim 5, wherein:

said plurality of light-emitting diodes are spaced apart in a symmetrical pattern substantially about the respective rounded surfaces of said concave head and said convex cover.

7. A light-emitting diode lamp according to claim 6, wherein said lamp body further comprises:

a stem substantially cylindrical in shape extending along the central axis of said lamp body between the respective ends thereof.

8. A lighting device comprising:

a main body constructed having a substantially cylindrical stem formed about a central axis and a rounded end having opposed spherical surfaces sealed together;

a plurality of light-emitting diodes electrically interconnected in series groups further connected in parallel and mounted circumferentially about the opposed spherical surfaces to project light emissions in substantially all radial directions relative thereto; and electrical means attached to said main body and electrically coupled to said light emitting diodes for conducting electrical power thereto.

9. A lighting device according to claim 8, wherein the opposed spherical surfaces of the rounded end of the main body further comprise:

a concave head formed symmetrically about the central axis; and a convex cover sealed to said concave head substantially thereupon.

10. In a signal light encasement of the type including a paraboloid mirror covered by a light-diffusing lens and supplied with electrical power, an improved lamp therefor comprising:

a lamp body constructed along a central axis and formed having opposed rounded surfaces sealed together at one end thereof;

a plurality of light-emitting diodes electrically interconnected and mounted circumferentially about the opposed rounded surfaces to project light emissions in respective radial directions relative thereto; and electrical means connected to said lamp body at the other end thereof and coupled to said light-emitting diodes for conducting the electrical power thereto.

11. The improved lamp for a signal light encasement according to claim 10, wherein:

said plurality of light-emitting diodes are uniformly spaced apart in a symmetrical pattern substantially about the respective opposed rounded surfaces.

12. The improved lamp for a signal light encasement according to claim 11, wherein the opposed rounded surfaces comprise:

a concave member formed symmetrically about the central axis of said lamp body open at the upper end thereof; and a convex cover fixed across the open end of said concave member.

13. The improved lamp for a signal light encasement according to claim 12, wherein said concave member is semi-spherical in configuration.

14. The improved lamp for a signal light encasement according to claim 12, wherein said concave member is paraboloidal in configuration.

* * * * *